United States Patent [19]

Tomisawa et al.

[11] Patent Number: 4,655,188

[45] Date of Patent: Apr. 7, 1987

[54] APPARATUS FOR LEARNING CONTROL OF AIR-FUEL RATIO OF AIR-FUEL MIXTURE IN ELECTRONICALLY CONTROLLED FUEL INJECTION TYPE INTERNAL COMBUSTION ENGINE

[75] Inventors: Naoki Tomisawa, Takasaki; Shoji Furuhashi, Yokohama; Seiichi Otani, Maebashi, all of Japan

[73] Assignee: Japan Electronic Control Systems Co., Ltd., Japan

[21] Appl. No.: 768,480

[22] PCT Filed: Jan. 23, 1985

[86] PCT No.: PCT/JP85/00024

§ 371 Date: Aug. 8, 1985

§ 102(e) Date: Aug. 8, 1985

[87] PCT Pub. No.: WO85/03329

PCT Pub. Date: Sep., 1985

[30] Foreign Application Priority Data

Jan. 24, 1984 [JP] Japan ..... 59-0009443
Jan. 24, 1984 [JP] Japan ..... 59-0009445
Jan. 24, 1984 [JP] Japan ..... 59-0009446

[51] Int. Cl.[4] ..... F02M 51/00
[52] U.S. Cl. ..... 123/489; 123/480
[58] Field of Search ..... 123/440, 478, 480, 486, 123/489

[56] References Cited

U.S. PATENT DOCUMENTS 4,466,410 8/1984 Sakakibara et al. ..... 123/440
4,467,770 8/1984 Arimura et al. ..... 123/489
4,539,958 9/1985 Ito et al. ..... 123/486 X
4,561,400 12/1985 Hattori ..... 123/440 X
4,566,420 1/1986 Sakamoto et al. ..... 123/489

FOREIGN PATENT DOCUMENTS 0106826 9/1976 Japan .
0151267 11/1981 Japan .
0204942 11/1983 Japan ..... 123/440
0203831 11/1984 Japan .

*Primary Examiner*—Willis R. Wolfe, Jr.
*Attorney, Agent, or Firm*—Lowe, Price, Leblanc, Becker & Shur

[57] ABSTRACT

In controlling the air-fuel ratio in an air-fuel mixture in an internal combustion engine, a pulse duty signal Tp corresponding to the basic fuel injection quantity is operated at least from the intake air flow quantity Q and the rotation speed N of the engine, a signal of a fuel injection quantity Ti corrected by adding an appropriate correction value to said Tp is applied to a pulse-controlled fuel injection apparatus. Feedback control is carried out so that the actually detected air-fuel ratio is made to follow the aimed air-fuel ratio, and the learning correction coefficient $\alpha o$ is operated by learning so that the correction coefficient for this feedback control is as small as possible and the operated value is given as a correction value to Tp. Since the reliability of $\alpha o$ is low in a driving state area where learning is not advanced, $\alpha o$ of the area where learning is not advanced is estimated from $\alpha o$ of areas where learning is advanced, whereby control of the air-fuel ratio in the transition stage between different areas is smoothened.

17 Claims, 9 Drawing Figures

APPARATUS FOR LEARNING CONTROL OF AIR-FUEL RATIO OF AIR-FUEL MIXTURE IN ELECTRONICALLY CONTROLLED FUEL INJECTION TYPE INTERNAL COMBUSTION ENGINE

TECHNICAL FIELD

The present invention relates to an apparatus for controlling the air-fuel ratio of an air-fuel mixture in an internal combustion engine provided with fuel injection means opened and closed in an on-off manner by a driving pulse signal given by electronic control means. More particularly, the present invention relates to an air-fuel ratio controlling apparatus in which the variable of the air-fuel ratio controlled by the apparatus is learned and the respondency of the control of the air-fuel ratio in the same engine-driving state is improved and in which the learned value of an engine-driving state area of a lower degree of the advance of learning is estimated from other engine-driving state areas and the smoothness of the air-fuel ratio in the boundary between a plurality of engine-driving state areas the degree of the advance of learning is improved.

BACKGROUND TECHNIQUES

An electronically controlled fuel injection valve is opened by a driving pulse signal (injection pulse) given synchronously with the rotation of an engine and while the valve is opened, a fuel is injected under a predetermined pressure.

Accordingly, the injection quantity of the fuel depends on the period of opening of the valve, that is, the injection pulse width. Assuming that this pulse width is expressed as Ti and is a control signal corresponding to the injection quantity of the fuel, Ti is expressed by the following equations:

$$Ti = Tp \times COEF \times \alpha + Ts \text{ and } Tp = K \times Q/N$$

wherein Tp stands for the injection pulse width corresponding to the basic injection quantity of the fuel, which is called "basic fuel injection quantity" for convenience, K stands for a constant, Q stands for the flow quantity of air sucked in the engine, N stands for the rotation speed of the engine, COEF stands for various correction coefficients for correcting the quantity of the fuel, which is expressed by the following formula:

$$COEF = 1 + Ktw + Kas + Kai + Kmr + Ketc$$

in which Ktw stands for a coefficient for increasing the quantity of the fuel as the water temperature is lower, Kas stands for a correction coefficient for increasing the quantity of the fuel at and after the start of the engine, Kai stands for a correction coefficient for increasing the quantity of the engine after a throttle valve arranged in an intake passage of the engine is opened, Kmr stands for a coefficient for correcting the air fuel mixture, and Ketc stands for other correction coefficient for increasing the quantity of the fuel, $\alpha$ stands for an air-fuel ratio feedback correction coefficient for the feedback control ($\lambda$ control), described hereinafter, of the air-fuel ratio of the air-fuel mixture, and Ts stands for the quantity of the voltage correction for correcting the change of the flow quantity of the fuel injected by the fuel injection valve, which is caused by the change of the voltage of a battery.

In short, the desired injection quantity of the fuel is obtained by multiplying the basic fuel injection quantity Tp by various correction coefficients COEF, and when a difference is brought about between the aimed value to be attained by the control and the actual controlled value, this difference is multiplied by $\alpha$ to effect the feedback control and the correction for the power source voltage is added to the feedback control.

The feedback control of the air-fuel ratio will now be described. An exhaust component concentration detecting member, for example, an $O_2$ sensor for detecting the oxygen component in the exhaust gas, is attached to an exhaust passage to detect the actual air-fuel ratio $\lambda$ of the air-fuel mixture sucked in the engine, and by comparing with a slice level, it is judged whether the actual air-fuel ratio $\lambda$ is richer or leaner than the aimed air-fuel ratio $\lambda t$. When a known ternary catalyst for efficiently converting CO, HC and $NO_x$, the main three exhaust gas components, at the theoretical air-fuel ratio is arranged in the exhaust system, the above-mentioned aimed air-fuel ratio $\lambda t$ is equal to the theoretical air-fuel ratio. Accordingly, in this case, by the slice level, it is judged whether the actual air-fuel ratio is richer or leaner than the theoretical air-fuel ratio, and the injection fuel quantity expressed by $Tp \times COEF$ is increased or decreased and controlled so that the actual air-fuel ratio becomes equal to the theoretical air-fuel ratio. For this control, the air-fuel ratio feedback correction coefficient $\alpha$ is set and the injection quantity $Tp \times COEF$ is multiplied by $\alpha$.

If it is intended to effect the feedback correction at a time by abruptly changing the value of the air-fuel feedback correction coefficient $\alpha$, the theoretical air-fuel ratio is overshot or undershot, and therefore, the value of the air-fuel ratio feedback correction coefficient is changed by the proportion and integration (PI) control so that the air-fuel ratio is stably controlled.

More specifically, in the case where the output of the $O_2$ sensor is higher or lower than the slice level, the air-fuel ratio is not abruptly leaned or riched, but in the case where the air-fuel ratio is rich (lean), the air-fuel ratio is first decreased (increased) only by the proportional (P) component, and is then gradually decreased (increased) by the integration (I) component unit so that the air-fuel ratio is leaned (riched). The P component is set at a value sufficiently larger than the I component unit.

In the region where the air-fuel ratio feedback control is not performed, the value of $\alpha$ is clamped to 1 or a constant value.

Needless to say, if the base air-fuel ratio in the region where the air-fuel ratio feedback control is effected, that is, the air-fuel ratio at the time when $\alpha$ is equal to 1, is set at the theoretical air-fuel ratio ($\lambda = 1$) through the entire region, the feedback control is inherently unnecessary. Practically, however, even if the base air-fuel ratio is set at $\lambda = 1$ in a specific driving state, the air-fuel ratio is ordinarily deviated from the theoretical air-fuel ratio in other driving state because of deviations or changes with the lapse of time among constituent members (such as an air flow meter, a fuel injection valve, a pressure regulator and a control unit), the non-linearity of the pulse width-flow amount characteristic of the fuel injection valve and changes of the driving conditions and environments. In this region where the deviation of the base air-fuel ratio occurs, the air-fuel ratio feedback control is performed so that this deviation is eliminated. This air-fuel ratio feedback correction control is disclosed in, for example, U.S. Pat. No. 4,284,050, U.S. Pat. No. 3,483,851 and U.S. Pat. No. 3,750,632.

However, in this air-fuel ratio feedback control, for example, when one stationary driving region is greatly changed to a different stationary driving region, if the base air-fuel ratio in this different stationary driving region is greatly deviated from $\lambda=1$, it takes too long a time to perform the PI control of the change of the base air-fuel ratio generated by this deviation to $\lambda=1$ by the feedback control. More specifically, even though the base air-fuel ratio has been obtained from the specific injection quantity $Tp\times COEF$ and the deviation of this air-fuel ratio from the theoretical air-fuel ratio has been corrected by the PI control based on $\alpha$, since the base air-fuel ratio is greatly changed, the base air-fuel ratio is controlled to a value greatly different from $\lambda=1$ if $Tp\times COEF$ used up to this time is still used, and the feedback correction by similar PI control should be performed and it takes a long time to correct the base air-fuel ratio to $\lambda=1$ by the feedback correction. In order to eliminate this disadvantage, it is necessary to improve the respondency of the control by increasing the PI constant. However, if the control respondency is thus improved, overshooting or undershooting is readily caused and the control performance is degraded. Namely, when the base air-fuel ratio is greatly deviated from $\lambda=1$, the control of the air-fuel ratio is effected in the region separate greatly from the theoretical air-fuel ratio.

Consequently, the driving is carried out in the range where the conversion efficiency of the ternary catalyst is low, and therefore, increase of the cost by increase of the amount of the noble metal in the catalyst is caused and the catalyst should be exchanged with new one frequently because of further reduction of the conversion efficiency due to deterioration of the catalyst.

A control system in which the above-mentioned disadvantage is eliminated by learning the control quantity controlled by the system and increasing the respondency of the air-fuel ratio control in the same driving state has been proposed by us in Japanese Patent Application Laid-Open Specifications No. 203828/84 and No. 203829/74 and U.S. patent application Ser. No. 604,025.

According to this control system, learning control of the air-fuel ratio feedback control is first carried out. More specifically, in the air-fuel ratio feedback control region, if the base air-fuel ratio is deviated from the aimed air-fuel ratio $\lambda t$, since the feedback correction coefficient $\alpha$ is increased for compensating this gap during the process of transfer, the driving state at this time and $\alpha$ are detected, and the learning correction coefficient $\alpha o$ based on this $\alpha$ is determined and stored. When the same driving state is brought about, the base air-fuel ratio is corrected to the aimed air-fuel ratio $\lambda t$ with a good respondency by the stored learning correction coefficient $\alpha o$. Storing of the learning correction coefficient $\alpha o$ is performed for all of engine-driving state areas of a predetermined range formed by lattice division of a map of RAM according to the rotation speed of the engine and the engine-driving conditions such as the load.

More specifically, the map of the learning correction coefficient $\alpha o$ corresponding to the rotation speed of the engine and the driving conditions of the engine such as the load is formed on RAM, and when the injection quantity Ti is calculated, the basic injection quantity Tp is corrected by $\alpha o$ as shown by the following equation:

$$Ti=Tp\times COEF\times\alpha\times\alpha o+Ts \quad (1)$$

Learning of $\alpha o$ is advanced according to the following procedures.

(i) The engine-driving state in the stationary state and the median $\alpha c$ of control of $\alpha$ (the mean value of a plurality of values $\alpha o$ at the time of reversion of increase of decrease of the output signal of the $O_2$ sensor) are detected.

(ii) The value $\alpha o$ (old) heretofore learned, corresponding to the engine-driving state, is retrieved.

(iii) The value of $\alpha o(old)+\Delta\alpha/M$ is determined from $\alpha c$ and $\alpha o(old)$, and the storage is renewed with the obtained value (learned value) being as new $\alpha o(new)$.

Incidentally, $\Delta\alpha$ stands for the deviation from the standard value $\alpha 1$ and expressed by $\Delta\alpha=\alpha-\alpha 1$. However, in order to take a mean value, $\Delta\alpha$ is expressed by $\Delta\alpha=\alpha c-\alpha 1$ and the standard value $\alpha 1$ is ordinarily set at 1.0 as the value corresponding to $\lambda=1$. M is a constant.

According to this learning system in the conventional air-fuel ratio feedback control, a good detection precision of the deviation quantity $\Delta\alpha$ is obtainable only in the stationary state, and therefore, only in the stationary state, learning is performed by detecting $\Delta\alpha$. Accordingly, learning is not performed in the area of the temporary driving state which passes in the transitional driving.

As the result, there are produced an area of a large degree of the advance of learning (hereinafter referred to as "learned area") and other area of a small degree of the advance of learning (hereinafter referred to as "unlearned area").

In the transitional stage between different engine-driving states, a step of the air-fuel ratio is produced between the learned area and the unlearned area or between two unlearned areas, and the exhaust emission in the transitional state is worsened and no substantial effect is attained.

It is therefore a primary object of the present invention to improve the control precision in the transitional driving stage by estimating the learning correction coefficient of the unlearned area from the area of other driving state of a large degree of the advance of learning and using the estimated learning correction coefficient $\alpha s$.

Another object of the present invention is to obtain the above-mentioned estimated learning correction coefficient $\alpha s$ from the learning correction coefficient $\alpha o$ stored in the neighbouring learned area by interpolatory calculation.

It is considered that among factors causing the deviation from the base air-fuel ratio of $\lambda=1$, those owing to changes of the characteristics of the fuel injection valve by adhesion of dusts, wearing and the like occupy large proportions. It also is considered that in the regions where the fuel injection quantity Tp is the same, the measurement error $\Delta Tp$ of the fuel injection quantity Tp is similarly the same. Furthermore, it is considered that among the factors causing the deviation from the base air-fuel ratio of $\lambda=1$, the measurement error of the flow quantity Q of intake air by the intake air flow quantity detecting means occupies a considerably large proportion, and for example, in case of a hot wire type air flow meter, the measurement error is prominently increased by adhesion of dusts to the hot wire or deterioration of the hot wire per se. In this case, it is considered that in the regions where the intake air flow quantity $\Delta Q$ is the same, also the measurement error $\Delta Q$ of Q is the same.

Therefore, another object of the present invention is to improve the reliability of the learned value and increase the precision of control of the air-fuel ratio by determining the estimated learning correction coefficient $\alpha s$ by estimating, based on the learned value $\alpha o$(new) now obtained by learning, the learning correction coefficient $\alpha o$ in an area of the driving state of a small degree of the advance of learning where the fuel injection quantity Tp or the intake air flow quantity Q is the same as in the driving state area of said new learned value.

DISCLOSURE OF THE INVENTION

In accordance with the present invention, the above objects are attained by an apparatus for learning control of the air-fuel ratio of an air-fuel mixture in an electronically controlled fuel injection type internal combustion engine, which comprises engine-driving state detecting means including at least first detecting means for detecting the flow quantity Q of intake air in the engine, second detecting means for detecting the rotation speed N of the engine and third detecting means for detecting the actual air-fuel ratio $\lambda$ of the air-fuel mixture sucked in the engine by detecting the concentration of the exhaust component, fuel injection means for injecting and supplying a fuel to the engine in an on-off manner in response to a driving pulse signal, basic fuel injection quantity operating means for operating a basic injection quantity Tp of the fuel to be supplied to the engine based on the flow quantity Q of intake air in the engine, which is put out by said first detecting means, and the engine rotation speed N put out by said second detecting means, reloadable memory means in which the learning correction coefficient $\alpha o$ for correcting said basic fuel injection quantity Tp is stored in advance for each of engine-driving state areas of a predetermined range, learning correction coefficient retrieval means for retrieving the learning correction coefficient $\alpha o$ from said memory means according to the actually detected driving state of the engine, feedback correction coefficient setting means for increasing or decreasing and setting the feedback correction coefficient $\alpha$ for correcting said basic fuel injection quantity Tp so that the actual air-fuel ratio $\lambda$ put out by said third detecting means is brought close to the preset aimed air-fuel ratio $\lambda t$, learning correction coefficient renewal means for setting a new learning correction coefficient $\alpha o$(new), which is operated based on the feedback correction coefficient $\alpha$ set by said feedback correction coefficient setting means and the learning correction coefficient $\alpha o$ retrieved by said learning correction coefficient retrieval means according to the detected driving state of the engine, as the learning correction coefficient $\alpha o$ of the corresponding engine-driving state area of said memory means, learning advance degree judging means for judging the degree of the advance of learning in each engine-driving state area by the frequency of renewal of the learning correction coefficient by said correction coefficient renewal means, estimated learning correction renewal means for estimating and operating the learning correction coefficient of the engine-driving state area, in which the degree of the advance of learning is judged as being small by said learning advance degree judging means, with a certain relation to the learning correction coefficient of the engine-driving state area in which the learning advance degree is judged as being large and setting said estimated learning correction coefficient $\alpha s$ as the learning correction coefficient $\alpha o$ of the corresponding engine-driving state area of said memory means, fuel injection quantity operating means for correcting the basic fuel injection quantity Tp based on the learning correction coefficient $\alpha o$ retrieved or renewed after retrieved and further correcting the basic fuel injection quantity Tp based on the feedback correction coefficient $\alpha$ set by said feedback correction coefficient setting means, and operating the fuel injection quantity Ti based on said corrected value, and driving pulse signal output means for putting out the driving pulse signal corresponding to the fuel injection quantity Ti to said fuel injection means.

In the present invention, according to this structural feature, the learning correction coefficient in the driving state area in which learning is not advanced can be estimated from the reliable learning correction coefficient $\alpha o$ of the driving state area in which learning is advanced through the estimated learning correction coefficient renewal means, and learning control of the air-fuel ratio can be performed based on the estimated learning correction coefficient $\alpha s$. Accordingly, the reliability of the learning correction coefficient of the unlearned area is improved, and when the engine-driving state is shifted between the learned area and the unlearned area or between the unlearned areas, the step in the controlled air-fuel ratio can be eliminated, overshooting or undershooting of the air-fuel feedback correction coefficient is controlled and stabilization of the air-fuel ratio to $\lambda=1$ is expedited.

Furthermore, in the above-mentioned apparatus for learning control of the air-fuel ratio, since as the estimated learning correction coefficient renewal means, there is adopted means for interpolating and operating the learning correction coefficient $\alpha o$ of the driving state area of a small learning advance degree from the learning correction coefficients $\alpha o$ of a plurality of driving state areas of a large learning advance degree present near said driving state area based on the result of the judgment from said learning advance degree judging means, the estimated learning correction coefficient $\alpha s$ of the unlearned area obtained from a plurality of reliable learnig correction coefficients $\alpha o$ has a very high reliability.

Moreover, in the above-mentioned apparatus for learning control of the air-fuel ratio according to the present invention, since said estimated learning correction coefficient renewal means is constructed to comprise area retrieval means for retrieving other driving state areas including the learning correction coefficient $\alpha o$(new) and the same basic injection quantity Tp or intake air flow amount Q as the basic injection quantity Tp or intake air flow quantity Q of the corrected driving state area and estimation renewal means for setting the learning correction coefficient of the driving state area, the learning advance degree of which is judged as being small by said learning advance degree judging means, among the retrieved driving state areas as the learning correction coefficient $\alpha o$(new) of the renewed driving state area, estimation of the estimated learning correction coefficient $\alpha s$ of the unlearned area can be done easily.

BEST MODES FOR CARRYING OUT THE INVENTION

The present invention will now be described in detail with reference to the accompanying drawings.

Figure 1:
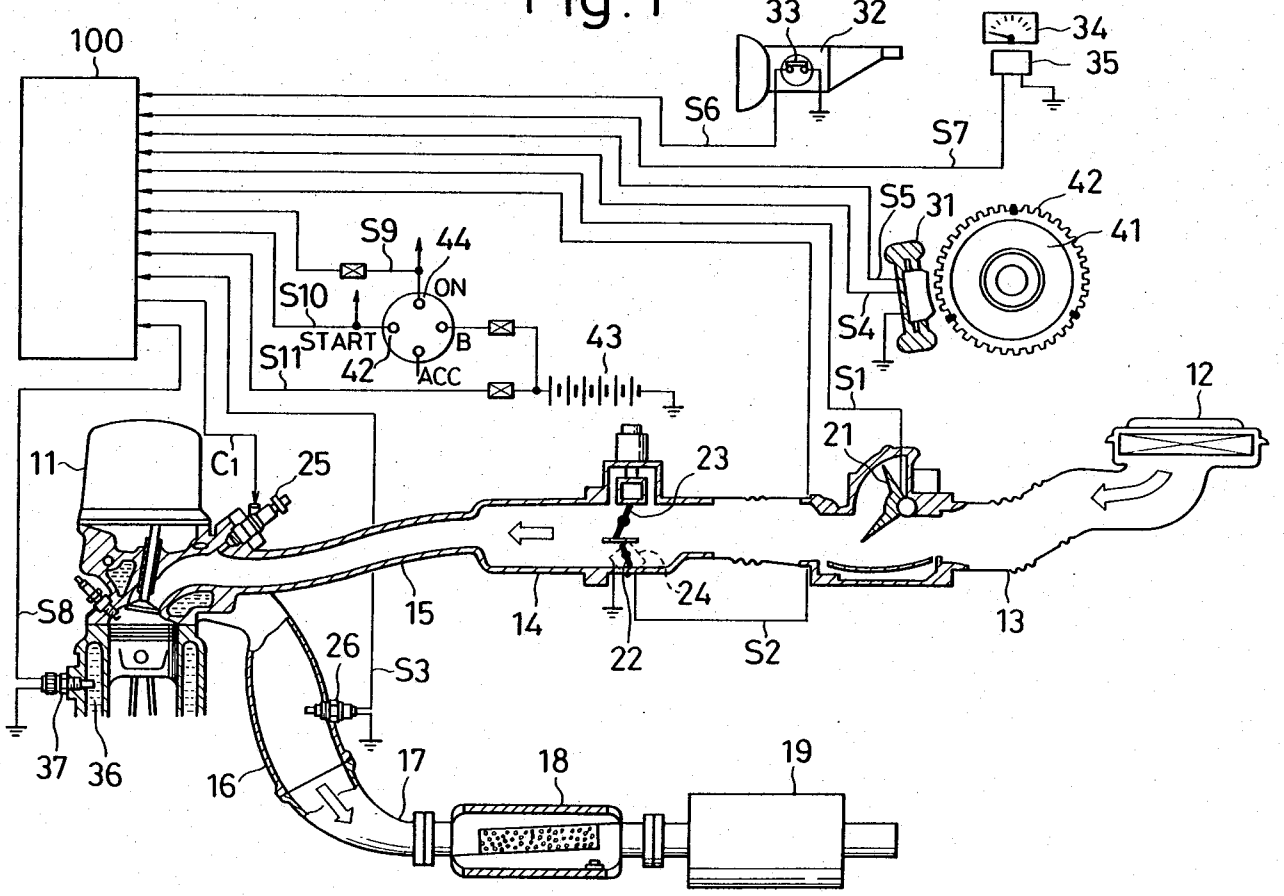
FIG. 1 is a schematic view illustrating an air-fuel ratio learning control apparatus according to one embodiment of the present invention.

Referring to FIG. 1, air is sucked in an engine 11 through an air cleaner 12, an intake duct 13, a throttle chamber 14 and an intake manifold 15 and an exhaust gas is discharged through an exhaust manifold 16, an exhaust duct 17, a ternary catalyst 18 and a muffler 19.

An air flow meter 21 is arranged in the intake duct 13 to put out a signal S1 of a flow quantity Q of intake air in the engine. The air flow meter 21 may be a hot wire type air flow meter. In the throttle chamber 14, a primary side throttle valve 22 interconnected with an accelerator pedal (not shown) and a secondary side throttle valve 23 are arranged to control the intake air flow quantity Q. A throttle sensor 24 of the variable resistor type is attached to a throttle shaft of the primary side throttle valve 22 to put out an electric current signal S2 corresponding to a change of the electric resistance corresponding to the turning angle, that is, the opening degree, of the throttle valve 22. An idle switch which is turned on when the throttle valve 22 is fully closed is mounted on the throttle sensor 24. A fuel injection valve 25 mounted on the intake manifold 15 or an intake port of the engine 11 is an electromagnetic fuel injection valve which is opened on actuation through a solenoid and is closed on deenergization. Namely, the valve 25 is actuated and opened through the solenoid by a driving pulse signal C1 to inject and supply into the engine a fuel fed under pressure from a fuel pump (not shown).

An $O_2$ sensor 26 acting as means for detecting the concentration of an exhaust component is arranged in the exhaust manifold 16. The $O_2$ sensor 26 is a known sensor which puts out a voltage signal S3 corresponding to the ratio of the oxygen concentration in the exhaust gas to air and the electromotive force of which is abruptly changed when an air-fuel mixture is burnt at the theoretical air-fuel ratio. Accordingly, the $O_2$ sensor is means for detecting the air-fuel ratio of the air-fuel mixture. The ternary catalyst 18 is a catalytic device for oxidizing or reducing CO, HC and NOx in the exhaust gas component at a high efficiency at an air-fuel ratio close to the theoretical air-fuel ratio of the air-fuel mixture to convert them to harmless substances.

These air flow meter 21, throttle sensor 24 and $O_2$ sensor 26 constitute parts of means for detecting the driving state of the engine and detection signals S1 through S3 of said detecting means are put out into a control unit 100. The means for detecting the driving state of the engine, which puts out these detection signals to the control unit 100, comprises, in addition to the above-mentioned members, a crank angle sensor 31, a neutral switch 33 mounted on a transmission 32, a car speed sensor 35 mounted on a speed meter 34 of a car, and a water temperature sensor 37 for detecting the temperature of cooling water in a water jacket 36 for cooling the engine or cooling water in a thermostat housing of the cooling water circulation system. The crank angle sensor 31 is arranged to detect a rotation speed N of the engine and a crank angle (piston position), and a signal disc plate 52 is mounted on a crank pulley 51 and the crank angle sensor 31 puts out a reference signal S4 by, for example, every 180° in the crank angle in case of a 4-cylinder engine or by every 120° in the crank angle in case of a 6-cylinder engine and a position signal S5 by, for example, every 1° in the crank angle according to teeth formed on the periphery of the plate 42. When the transmission 32 is set at the neutral position, the neutral switch 33 detects this and puts out a signal S6. The car speed sensor 35 detects the car speed and puts out a car speed signal S7. The water temperature sensor 37 puts out a voltage signal S8 changing according to the change of the temperature of cooling water corresponding to the temperature of the engine.

The means for detecting the driving state of the engine further comprises an ignition switch 41 and a start switch 42. The ignition switch 41 is a switch for applying a voltage of a battery 43 to an ignition device and putting out an on-off signal S9 to the control unit 100. The start switch 42 is a switch which is turned on when a starter motor is driven to start the engine and which puts out an on-off signal S10. The terminal voltage of the battery 43 is put out to the control unit 100 by a signal S11.

The detection signals S1 through S11 emitted from the respective elements of the means for detecting the driving state of the engine are put into the control unit 100 where the operation processing is carried out to put out a signal C1 of an optimum injection pulse width to the fuel injection valve and obtain a fuel injection quantity giving an optimum air-fuel ratio.

Figure 2:
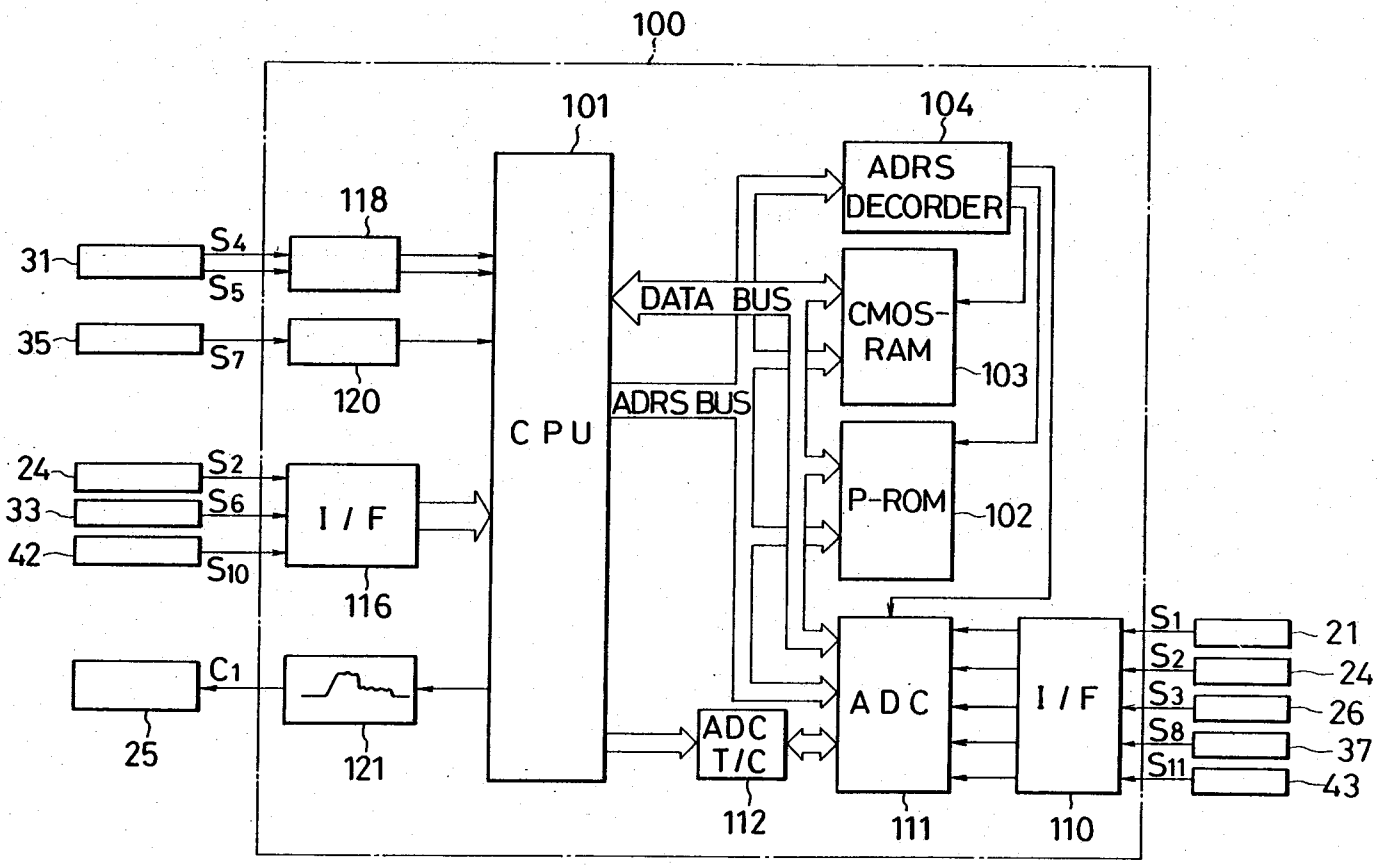
FIG. 2 is a block diagram showing a hard ware structure of a control unit used in the embodiment of the present invention.

The control unit 100 comprises CPU 101, P-ROM 102, CMOS-RAM 103 for the learning control of the air-fuel ratio and an address decoder 104, as shown in FIG. 2. A back-up power source circuit is used for RAM 103 to retain the content of the memory after the ignition switch 41 has been turned off.

An analogue input signals to be put in CPU 101 for the control of the fuel injection quantity, there can be mentioned the signal S1 of the intake air flow quantity Q from the air flow meter 21, the throttle opening degree signal S2 from the throttle sensor 24, the water temperature signal S8 from the water temperature sensor 37, the signal S3 of the oxygen concentration in the exhaust gas from the $O_2$ sensor 26 and the battery voltage signal S11. These signals are put in CPU 101 through an analogue input interface 110 and an A/D converter 111. The A/D converter 111 is controlled by CPU 101 through an A/D conversion timing controller 112.

As digital input signals, there can be mentioned the idle switch signal S2 which is turned on when the throttle valve 22 is fully closed, and ON-OFF signals S10 and S6 supplied from the start switch 42 and the neutral switch 33. These signals are put in CPU 101 by way of a digital input interface 116.

Furthermore, for example, the reference signal S4 and position signal S5 from the crank angle sensor 31 are put in CPU 101 through a one-shot multichip circuit 118. Moreover, the car speed signal S7 from the car speed sensor 35 is put in CPU 101 through a wave shaping circuit 120.

The output signal from CPU 101 (driving pulse signal to the fuel injection valve 25) is supplied to the fuel injection valve 25 through a current wave control circuit 121.

Figure 3:
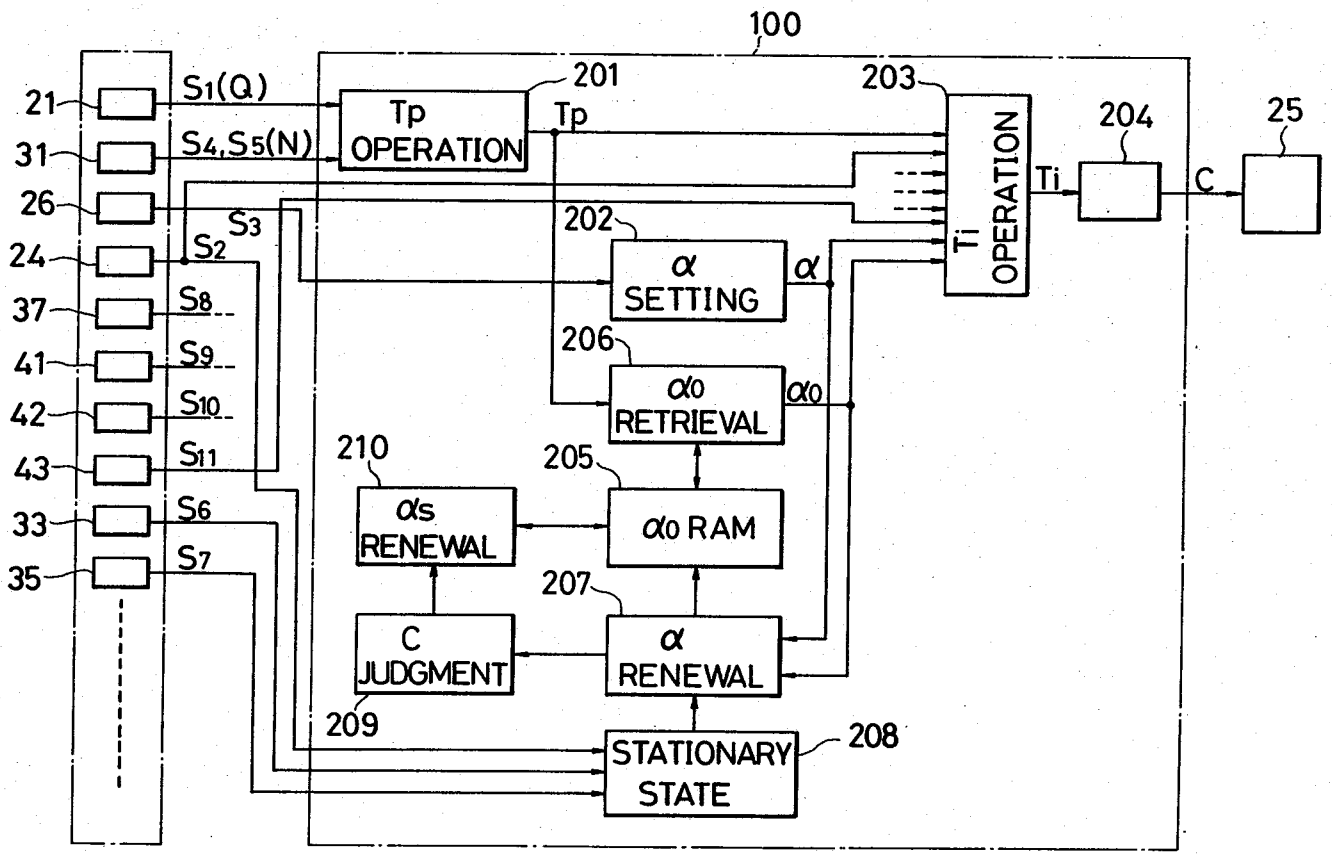
FIG. 3 is a block diagram in the air-fuel ratio learning control apparatus of the embodiment of the present invention at the time of the feedback control of the air-fuel ratio.
Figure 4:
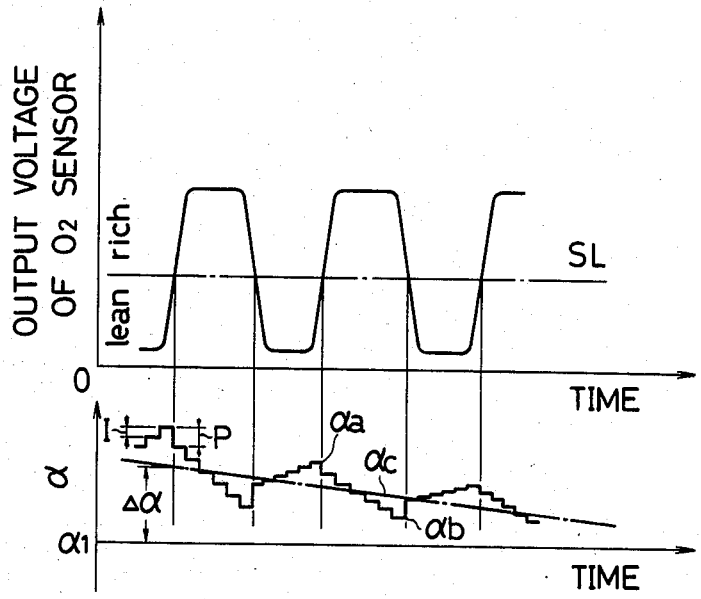
FIG. 4 is a graph showing the output voltage characteristics of an $O_2$ sensor and the air-fuel ratio feedback control characteristics.

CPU 101 performs the input and output operations and computing processing according to the program based on the block diagram of FIG. 3 and the flow chart (fuel injection quantity calculation routine) of FIG. 4 (this program is stored in ROM 102) to control the fuel injection quantity.

Referring to FIG. 3, basic fuel injection quantity operating means 201 arithmetically operates the injection pulse signal Tp corresponding to the basic fuel injection quantity according to the equation of $Tp=K\cdot Q/N$ based on the signal S1 of the intake air flow quantity detected by the air flow meter 21 and the signals S4 and S5 of the engine rotation speed N detected by the crank angle sensor 31.

Air-fuel ratio feedback correction coefficient setting means 202 receives an output voltage signal S3, as shown in FIG. 4, which is put out from the $O_2$ sensor 26 and corresponds to the actual air-fuel ratio $\lambda$ determined by the oxygen concentration in the exhaust gas, and said setting means 202 judges by comparing means whether the actual air-fuel ratio is richer or leaner than the slice level voltage SL as the aimed air-fuel ratio $\lambda t$, and so as to bring the actual air-fuel ratio close to $\lambda t$, said setting means 202 sets the air-fuel ratio feedback correction coefficient $\alpha$ by increasing or decreasing the feedback quantity by the proportional component (P) and the predetermined integration component unit (I). Ordinarily, the initially set value of $\alpha$ is 1.

Fuel injection quantity operating means 203 receives the Tp signal put out from the basic fuel injection quantity operating means 201, the signal of the air-fuel ratio feedback correction coefficient $\alpha$ from the air-fuel ratio feedback correction coefficient setting means 202 and various detection engine parameters S3, S2, S8, S9, S10 and S11 put out from various means 24, 37, 41, 42, and 43 for detecting the driving state of the engine, and said operating means 203 puts out a fuel injection quantity (pulse) signal Ti according to the equations of $Ti=Tp\times COEF\times\alpha+Ts$ and $COEF=1+Ktw+Kas+Kai+Kmr+Ketc.$ Driving pulse signal output means 204 puts out a driving pulse signal C1 corresponding to the fuel injection quantity Ti to the fuel injection valve 25, and the fuel is injected into the engine from the fuel injection valve 25 in such an amount that the desired theoretical air-fuel ratio $\lambda t$ is attained. The stages described hereinbefore are well-known.

Figure 5:
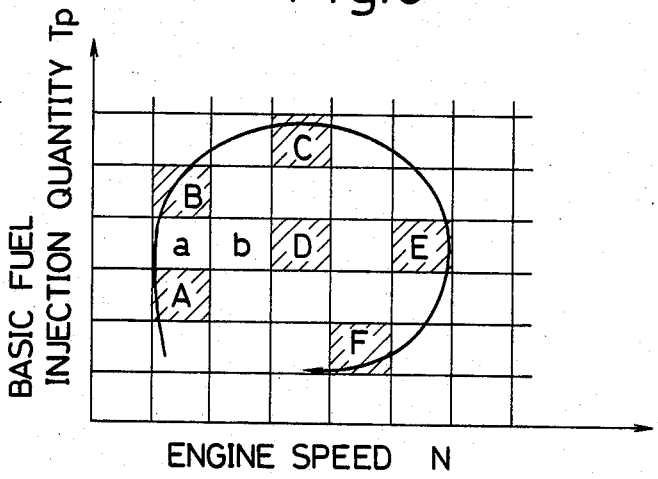
FIG. 5 is a diagram illustrating the engine-driving state areas of RAM functioning as memory means.

Memory means 205 consists of random access memory (RAM) 103 in which the learning correction coefficient $\alpha o$ for correcting the basic fuel injection quantity Tp is stored in advance for each driving state area of the engine, as shown in FIG. 5. The initially set value of $\alpha o$ is 1. It is difficult to set the air-fuel ratio of $\alpha=1$, that is, the theoretical air-fuel ratio, through the entire region. Practically, even if the base air-fuel can be set at 1 in a specific driving state, the air-fuel ratio is deviated from the theoretical air-fuel ratio in other driving states because of dimensional deviations of the constituent members, changes of these members with the lapse of time, the non-linearity of the pulse width-flow amount characteristic of the fuel injection valve and changes of the driving conditions and environments. The air-fuel ratio feedback correction coefficient $\alpha$ is determined so that the deviation is eliminated in the region where this deviation is caused. However, in the case where the value $\alpha$ is too large, that is, the deviation of the air-fuel ratio from the theoretical air-fuel ratio is too large and the value of $\alpha$ for eliminating this deviation is too large, it takes too long a time to change the air-fuel ratio to $\lambda=1$ by the PI control. Accordingly, $\alpha$ is set at a small value but the value of $Tp\times COEF$ is multiplied by the learning correction coefficient $\alpha o$ so as to correct the base air-fuel ratio. This learning correction coefficient $\alpha o$ is stored in the memory means 205.

Learning correction coefficient retrieval means 206 retrieves the learning correction coefficient $\alpha o$ from the memory means 205 according to the detected engine parameters, for example, Tp and N.

Learning correction coefficient renewal means 207 operates a new learning correction coefficient $\alpha o$(new) based on the feedback correction coefficient $\alpha$ set by the feedback correction coefficient setting means 202 and the learning correction coefficient $\alpha o$(old) retrieved by the learning correction coefficient retrieval means 206 according to the driving sstate of the engine, and said renewal means 207 sets this $\alpha o$(new) as the learning correction coefficient $\alpha o$ for the corresponding driving state of the engine in the memory means 205.

The new learning correction coefficient $\alpha o$(new) is arithmetically operated according to the weighted average of the stored learning correction coefficient $\alpha o$ and the set feedback correction coefficient $\alpha$, that is, $\alpha o(new)\rightarrow(\alpha+(M-1)\times\alpha o(old))/M$ or $\alpha o(new)\rightarrow\alpha o(old)+\Delta\alpha/M$ [in which M is a constant and as shown in FIG. 4, $\Delta\alpha$ is a deviation ($\alpha c-\alpha 1$) of the air-fuel ratio feedback correction coefficient $\alpha$ from a certain set standard value (ordinarily 1)]. Namely, in each case, the value $\alpha o$(new) is obtained by performing operation and correction while adding the newly set air-fuel feedback correction coefficient $\alpha$ to the previously written learning correction coefficient $\alpha o$(old). In short, $\alpha o$(old) is not directly substituted for $\alpha$.

The injection quantity operating means 203 receives $\alpha o$ before or after renewal, which has been retrieved by the learning correction coefficient retrieval means 206 and operates the injection quantity Ti according to the equation (1). Accordingly, since $\alpha$ obtained at this time is rendered small because of the influence of $\alpha o$, the quantity of the feedback correction can be reduced and the response characteristics of the control of the air-fuel ratio can be improved.

Means 208 for detecting the stationary state of the engine puts out a signal to actuate the learning correction coefficient renewal means 207 when the means 208 detects the stationary state of the car based on the outputs of the throttle sensor 24, the crank angle sensor 33 and car speed sensor 35. Since the feedback correction coefficient $\alpha$ at the transient stage varies, this signal is eliminated.

The learning advance degree judging means 209 counts the frequency C of renewal of the learning correction coefficiency for each engine-driving state area by the learning correction coefficiency renewal means 207 and compares the frequency C with a predetermined frequency C1 to judge the degree of the advance of learning. The predetermined frequency C1 may be a preset value, or a mean value of the learning correction coefficient renewal frequencies C of all the driving state areas or a value obtained by adding a predetermined value to this mean value or multiplying the mean value by a predetermined value. The latter case is advantageous in that from the initial stage of learning, renewal of the learning correction coefficient of the unlearned area, that is, substantial learning, can be performed and even after learning is generally advanced, the learning correction coefficient of the substantially unlearned area (the area in which the practical learning frequency is small and the reliability of learning is low) can be renewed, with the result that good learning can be performed continuously.

The estimated learning correction renewal means 210 estimates the learning correction coefficient $\alpha o$ of the driving state area, the learning advance degree of which is determined as being small by the learning advance degree judging means 209, to be a value of a higher precision and writes this estimated value on RAM 103. More specifically, the above-mentioned correction coefficient $\alpha o$ is estimated and operated with a certain relation to the driving state area, the learning advance degree of which is judged as being large. For example, the learning correction coefficient of the driving state, the learning advance degree of which is judged as being small, is interpolated and operated from the learning correction coefficient of the neighbouring driving state area, the learning advance degree of which is judged as being large.

Figure 6A:
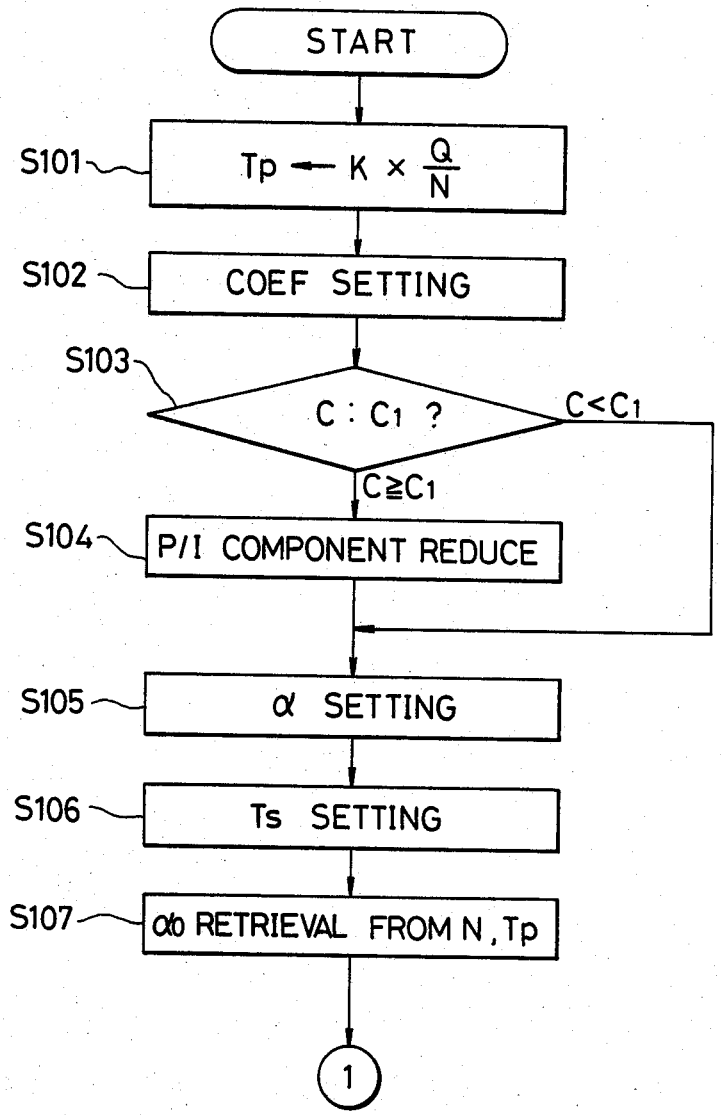
FIG. 6 is a flow chart showing operations of the air-fuel ratio learning control apparatus shown in FIG. 3.
Figure 6B:
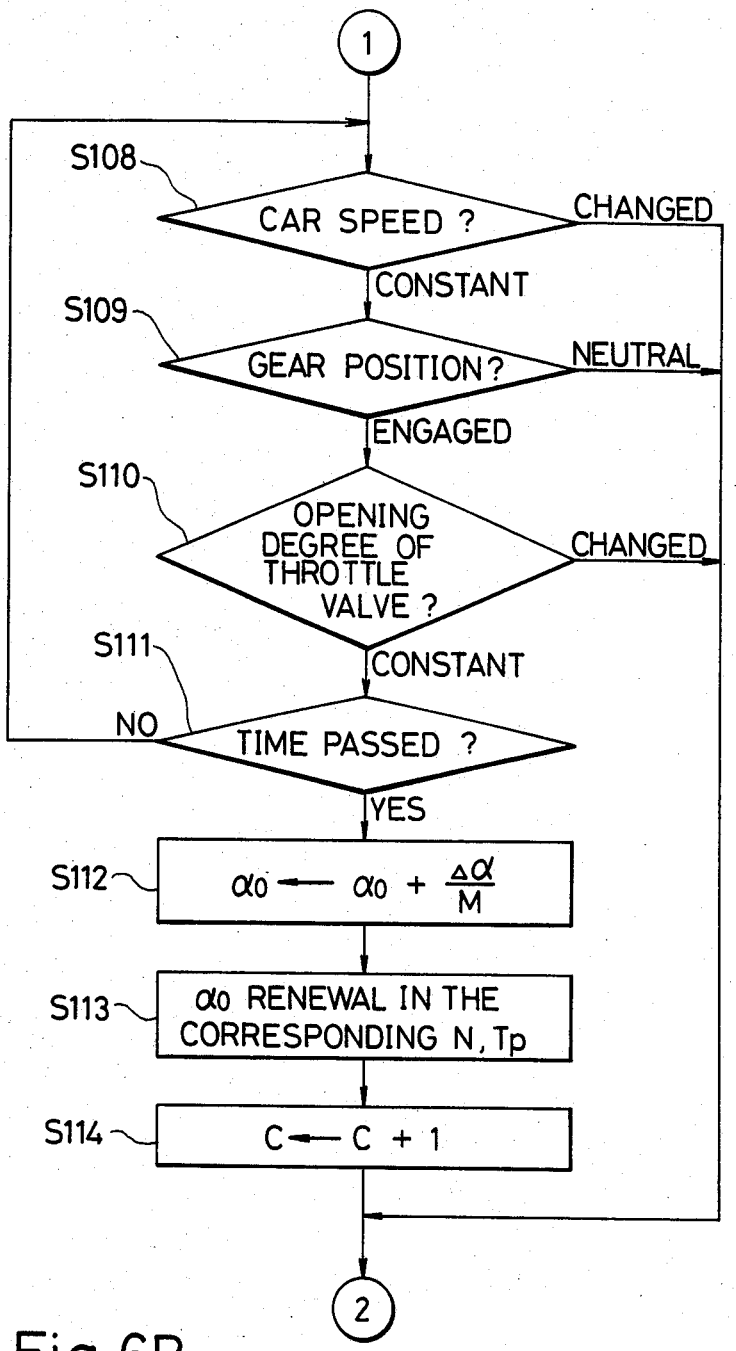
Figure 6C:
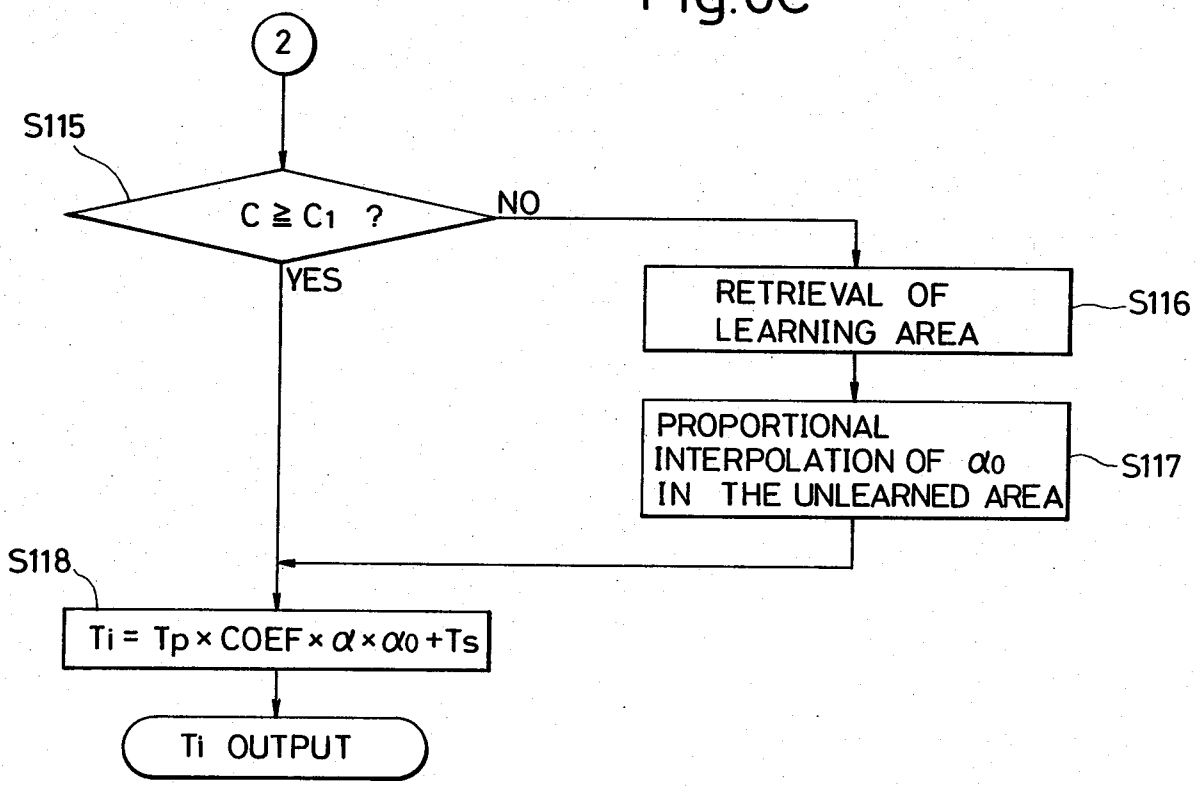

The flow chart shown in FIG. 6 will now be described.

The operation routine shown in this flow chart is performed at every predetermined time unit.

In S101, the basic fuel injection quantity $Tp=K\times(Q/N)$ is arithmetically operated from the intake air flow quantity Q obtained by the signal from the air flow meter 21 and the engine rotation speed N obtained by the signal from the crank angle sensor 31.

In S102, various correction coefficients COEF are set.

In S103, the count value C of the renewal frequency counter (which is counted up in S114 described hereinafter) for counting the frequency of the renewal of the learning correction coefficiency $\alpha o$ is compared with the predetermined value C1, and when the count value C is larger than the predetermined value C1, in S104 the P/I component of the $\lambda$ control (see FIG. 4) is reduced by a predetermined quantity and the flow is advanced to S105. When the count value C is smaller than the predetermined value C1, the P/I component is not changed and the flow is advanced to S105.

In S105, the output voltage S3 of the $O_2$ sensor 26 is compared with the slice level voltage and the air-fuel ratio feedback correction coefficient $\alpha$ is set by the proportional integration control by using the P/I component.

In S106, the voltage correction quantity Ts is set based on the battery voltage signal S11 from the battery 43.

In S107, the learning correction coefficient $\alpha o$ is retrieved from the engine rotation speed N and the basic injection quantity (load) Tp. The map of the learning correction coefficient $\alpha o$ to the rotation speed N and load Tp is stored in renewal-enable RAM 103, and when learning is not initiated, $\alpha o$ is equal to 1.

From S108 to S111 are arranged to detect the stationary state of the engine.

In S108, the change of the car speed is judged based on the signal S7 from the car speed sensor 35. In S109, the gear position is judged from the signal S6 from the neutral switch 33 and in S110, the change of the opening degree of the throttle valve is judged based on the signal S2 from the throttle sensor 24, and in S111, it is decided whether or not the predetermined time has passed and if the predetermined time has not passed, the flow returns to S108. In the case where the change of the car speed within the predetermined time is below the predetermined value the engine speed is in almost constant state, the gear is actuated and the opening degree of the throttle is below the predetermined value for the predetermined time, it is decided that the engine is in the stationary state and correction of the learning correction coefficient in S112 and S113 is effected. In the case where at an optional point within the predetermined time, the change of the car speed exceeds the predetermined value, the gear is in the neutral state and the change of the degree of the throttle exceeds the predetermined value, it is decided that the engine is in the transitional state and correction of the learning correction coefficient $\alpha o$ in S112 and S113 is not effected.

On judgment of the stationary state, the learning correction coefficient $\alpha o$ is corrected in S112 in the same manner as described above with reference to the conventional technique according to the following equation:

$$\alpha o(\text{new}) \leftarrow \alpha o(\text{old}) + \Delta\alpha/M$$

In S113, the new learning correction coefficient $\alpha o$ is written in the corresponding engine rotation speed N and load Tp of RAM 103. In short, data in RAM are renewed.

In S114, the count value C of the renewal frequency counter for counting the renewal frequency of the learning correction coefficient $\alpha o$ in the present driving state area is counted up.

In S115, the count value C of the above-mentioned counter for counting the renewal frequency in the present driving state area is compared with the predetermined value C1, and in case of $C \geqq C1$ where the learning advance degree is large, the flow is directly advanced into S118 and the injection quantity Ti is operated as described below.

When the case of $C < C1$ where the learning advance degree is small is judged in S115, the learning area where C is larger than or equal to C1 is retrieved in S116 among the driving state areas surrounding said unlearned area.

For example, In FIG. 5, in the case where the driving state is changed in the direction of an arrow, for the unlearned area a, the learned areas A and B below and above the area a in the map are retrieved (for the unlearned area b, the learned areas A, B and D are retrieved).

In S117, the learning correction coefficients $\alpha o$ in the learned areas, for example, the areas A and B, are read out in S117, and the estimated learning correction coefficient $\alpha s$ in the unlearned area a is operated from these coefficients $\alpha o$ by proportional interpolation, and this estimated learning correction coefficient $\alpha s$ is set as the learning correction coefficient $\alpha o$ of the unlearned area a.

In S118, the injection quantity Ti is calculated according to the following equation:

$$Ti = Tp \times COEF \times \alpha \times \alpha o + Ts$$

The injection quantity Ti is thus calculated and the driving pulse signal is given at a predetermined timing to the fuel injection valve 25 through the electric current wave shaping circuit 121.

In view of matching, it is preferred that the map of the learning correction coefficient stored in RAM should comprise about 8 lattices for the engine rotation speed N and about 4 lattices for Tp.

In the learned area, the injection quantity can be controlled at a high precision by the learning correction coefficient $\alpha o$ learned in this area actually during the driving, and in the unlearned area, the injection quantity is controlled by using the estimated learning correction coefficient having a high reliability, which is obtained by interpolation based on the learning correction coefficients of neighbouring learned areas. Accordingly, there is no step of the air-fuel ratio between the learned and unlearned areas and worsening of the exhaust transmission in the transition stage can be prevented, and the characteristics can be smoothened in the transition stage.

Incidentally, in the foregoing embodiment, as is apparent to those skilled in the art, the P component may be excluded from the PI component constant at the time of the air-fuel ratio feedback control or a part of the I component may be regarded as this PI component constant.

Another embodiment of the present invention will now be described with reference to the flow chart of FIG. 7. The hardware structure is the same as in the foregoing embodiment.

In S301, the basic injection quantity Tp is operated and in S302, various correction coefficients COEF are set. In S303, the air-fuel ratio feedback correction coefficient $\alpha$ is set and in S304, the voltage correction component Ts is set. These steps are the same as the steps S101, S102, S105, S106 and S107 shown in FIG. 6.

In S305, the learning correction coefficient $\alpha o$ corresponding to (N, P) stored in the area of RAM 103 where the rotation number N of the engine and the basic injection quantity Tp are present is retrieved from N and Tp.

S306 to S308 consist of the flow of the means for detecting the stationary state of the engine.

In S306, the area of the present driving state (N, Tp) is retrieved from the detected engine rotation speed N and basic injection quantity Tp by utilizing RAM 103 where learning correction coefficients $\alpha o$ are stored for predetermined divided driving state areas of the engine rotation speed N and basic injection quantity Tp. The data of the retrieved area are set at the predetermined address A formed separately from the map of the learning correction coefficient $\alpha o$ in RAM 103.

In S307, the data of the area set at the address A are compared with the area data stored at the address LA of RAM 103 where the driving state area is retrieved precedently, and it is judged whether or not the area data are the same as the precedent data. In case of "YES", the flow is advanced to S308.

In S308, it is judged whether or not the output voltage of the $O_2$ sensor is reversed from the rich side to the lean side n times after the judgment of "YES" in S307, and in case of "YES", the flow is advanced to S309.

More specifically, steps S307 and S308 are formed to determined whether or not the engine is in the stationary state by the presence of the driving state in one area for a predetermined time. This predetermined time may be a certain time. If each of the judgments at S307 and S308 is "YES", it is judged that the engine is in the stationary state. If one of the judgements at S307 and S308 is "NO", it is judged that the engine is in the non-stationary state. In this case, the flow is advanced to S318 without passing through steps S309 to S317.

In S309, the control median value $\alpha c$ of the air-fuel ratio feedback correction coefficient $\alpha$ in the stationary state is operated. This control median value $\alpha c$ may be obtained, for example, by calculating the mean value in the range of from the point of increase or decrease reversion of the air-fuel ratio feedback correction coefficient $\alpha$ to the point of subsequent reversion or by calculating the mean value of two air-fuel ratio feedback correction coefficients $\alpha a$ and $\alpha b$ at the times of reversion, that is, $\frac{1}{2}\cdot(\alpha a+\alpha b)$ (see FIG. 4). In this manner, the control median value $\alpha c$ in the stationary state can be determined precisely.

In S310, arithmetic operation is carried out by using the learning correction coefficient $\alpha o$ retrieved in S305 and the control median value $\alpha c$ according to the following equation, and the obtained value is set as the new learning correction coefficient $\alpha o$(new) to effect renewal of the value in the corresponding area of the $\alpha o$ map and in S311, the count value of the renewal frequency counter arranged for each area is renewed:

$$\alpha o \rightarrow \alpha o + \Delta\alpha / M$$

The value M determining the addition proportion of the learning deviation $\Delta\alpha$ of the learning correction coefficient $\alpha o$ may be constant, but if the value M is made proportional to the rotation number of the engine, the PI component of $\alpha$ can be reduced with increase of the injection frequency and hence, the precision of the control of the injection quantity can be increased.

In S312, the data of the driving state area newly set at the address A of RAM 103 are transferred to the address LA.

In S313, the count value C of the renewal frequency counter in the present driving state area is compared with the predetermined value C1, and in case of $C \geqq C1$ where the degree of the advance of learning is large, the learning correction coefficient $\alpha o$ is regarded as being reliable and is transferred to S314 to estimate the learning correction coefficient $\alpha o$ of the unlearned area having a specific relation to the above-mentioned area. However, in case of the unlearned state where the count value C is smaller than the predetermined value C1, the operated learning correction coefficient $\alpha o$ is not used for estimation of the learning correction coefficient of other area but the flow is advanced to S318.

In S314, from the renewed driving state range of the αo map of RAM 103, the other driving state area where the basic fuel injection quantity Tp is the same as the presently detected value (N, Tp) is retrieved. This means is called "area retrieving means".

In S315, the count value Ce of the renewal frequency counter of each area retrieved in S314 is retrieved, and in S316, it is judged whether or not the count value Ce of each area is smaller than C1, whereby it is judged whether or not said area is an unlearned area of a small degree of the advance of learning.

If the judgement of Ce<C1 in S316 is "YES", that is, if it is judged that the area is an unlearned area, the flow is advanced in S317, and the learning correction coefficient αoe of said area is estimated to be equal to the learning correction coefficient αo learned in the newest learning area and the coefficient αo is substituted for αoe.

It is considered that among factors causing the deviation from the base air-fuel ratio of λ=1, those owing to changes of characteristics of the fuel injection valve by adhesion of dusts, wearing and the like occupy large proportions.

It is considered that in the region where the fuel injection quantity Tp (or Ti) is the same, the measurement error ΔTp of Tp is similarly the same. Accordingly, it is construed that the learning correction coefficients of the respective areas become substantially equal to one another with advance of learning.

Accordingly, if the learning correction coefficient αoe of the unlearned area in which learning is not practically advanced is substituted by the learning correction coefficient αo of the learned area, the estimated learning correction coefficient close to the value obtainable when learning is advanced, and smooth driving characteristics are obtained in the transition state and the fuel cost characteristics and the like can be improved.

Furthermore, it is considered that among the factors causing the deviation from the base air-fuel ratio of λ=1, the measurement error αQ of the flow quantity Q of intake air by the air flow meter occupies a considerably large proportion, and for example, in case of a hot wire type air flow meter, the measurement error is prominently increased by adhesion of dusts to the hot wire or deterioration of the hot wire per se.

Also in this case, it is considered that in the regions where the intake air flow quantity Q is the same, the measurement error ΔQ of Q is similarly the same. Accordingly, the learning correction coefficients αo of the respective areas should become substantially equal with advance of learning.

Figure 9:
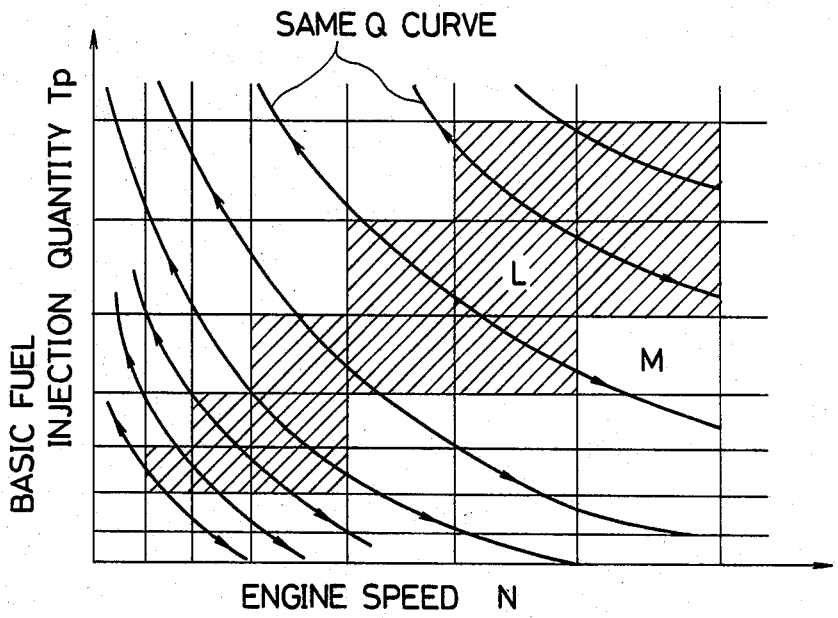
FIG. 9 is a graph showing the manner in which from the learning correction coefficient $\alpha o$ of the learned area to be renewed, the learning correction coefficient of the unlearned area having the same intake air flow quantity Q as that of said learned area is estimated.

Therefore, the learning correction coefficient αoe of the unlearned area M may be estimated from the learning correction coefficient αo of the learned area L where the intake air flow quantity Q is the same as that of the unlearned area, as shown in FIG. 9.

Figure 7A:
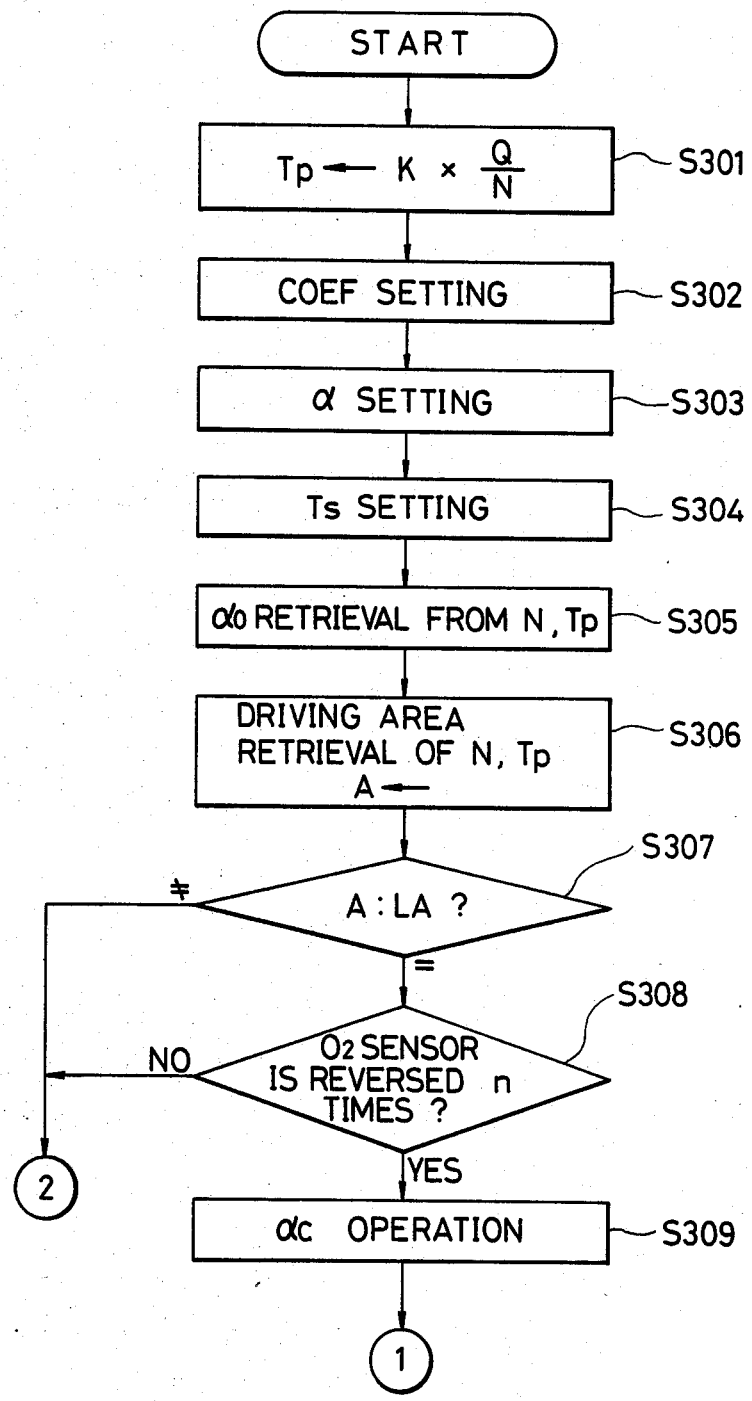
FIG. 7 is a flow chart showing operations of an air-fuel ratio learning control apparatus according to another embodiment of the present invention.
Figure 7B:
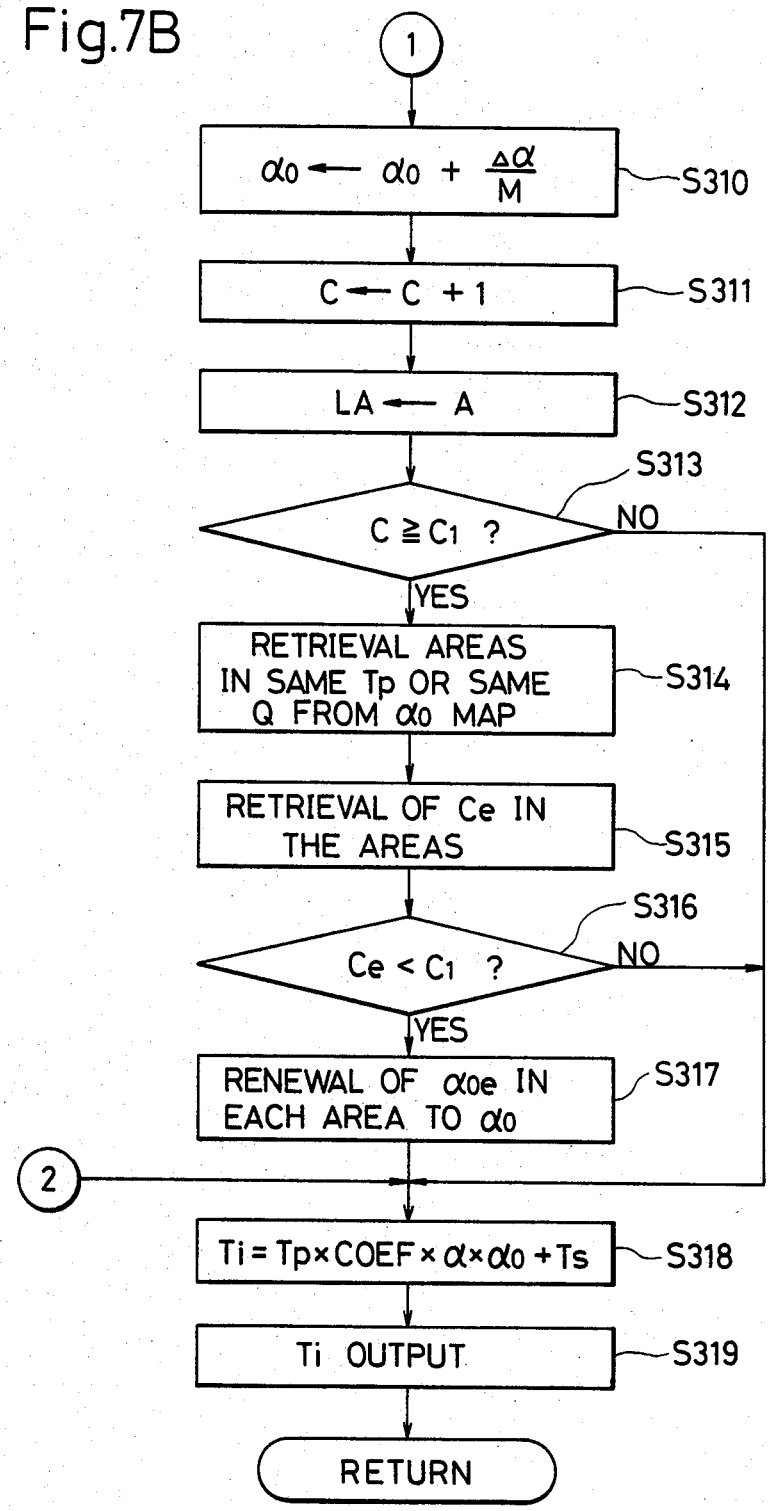

More specifically, there may be adopted a method in which in S314, other driving state areas where the intake air quantity is the same as that of the intended area are retrieved in FIG. 7, and αoe of these other areas is substituted as the renewed αo value of said area in S317 in the same manner as described above. In short, the function of estimating renewal means is exerted in S317.

Figure 8:
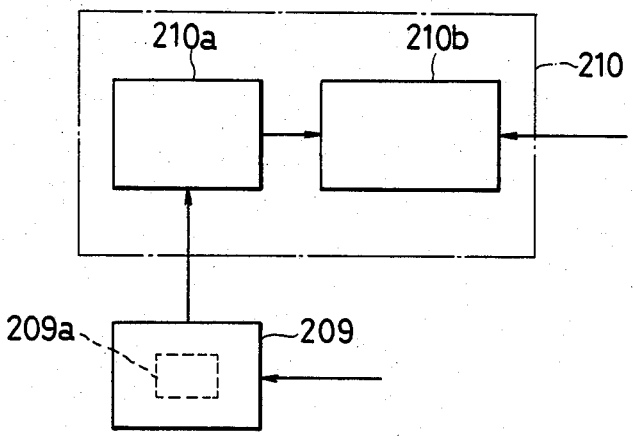
FIG. 8 is a block diagram showing another embodiment of estimated learning correction renewal means shown in FIG. 3.

In short, in the present embodiment, the estimated learning correction coefficient renewal means shown in FIG. 3 comprises the area retrieving means 210*a* in S314 and estimation renewal means 210*b* in S317, as shown in FIG. 8.

Incidentally, there may be adopted a modification in which the estimation renewal means 210*b* is constructed to include comparing means 210*c* for comparing the degree of the advance of learning in the renewed driving state area with the learning advance degree of other driving state areas having the same Tp or Q as that of the renewed driving state area, and rewriting is effected by estimation made only on other driving state area in which the degree of the advance of the learning is smaller than in the renewed area. If this modification is adopted, renewal of the learning correction coefficient αo in the area having a relatively small degree of the advance of learning is made based on the learning correction coefficient of a higher reliability in the area having a relatively large degree of the advance of learning, and the reliability of the renewed learning correction coefficient αo is improved.

In the case where the judgment in S316 is "NO", that is, in the area where the degree of the advance of learning is judged as being large, the data are not renewed but are retained.

In S318, the injection quantity Ti is operated according to the above-mentioned equation (1).

In case of the stationary state, αo(new) renewed in S310 is used as the learning correction coefficient αo, and in case of the transition state, the learning correction coefficient not renewed in S310, that is, the old learning correction coefficient αo(old) retrieved in S305, is used.

The injection quantity Ti is arithmetically operated in the above-mentioned manner, and the driving pulse signal corresponding to this injection quantity Ti is given at a predetermined timing to the fuel injection valve 25.

In the driving state area where the λ control is not effected, the air-fuel ratio feedback correction coefficient α is clamped to 1, and the operations of steps S309 through S317 are omitted, and the learning correction coefficient αo on the line of the same basic fuel injection quantity Tp or intake air flow quantity Q is retrieved in S305 and is used. Accordingly, the injection quantity is given by the following equation;

$$Ti = Tp \times COEF \times \alpha o + Ts$$

In the present embodiment, there is adopted a structure in which data of the unlearned area are renewed by the learned data, but there may be adopted a modification in which only a predetermined proportion of the data in the unlearned area is renewed while taking the influence of the measurement error of the fuel injection quantity Tp or intake air flow quantity Q on the deviation from λ=1. Furthermore, the learning correction coefficient may be renewed by an average value obtained, for example, by taking a weighed mean of the renewed learning correction coefficient αo(new) in the learned area and the old learning correction coefficient αo(old) in the unlearned area.

Industrial Utilizability

As is apparent from the foregoing description, the apparatus for learning control of the air-fuel ratio in an air-fuel mixture according to the present invention is especially suitable for control of the air-fuel ratio in an electronically controlled fuel injection type internal combustion engine, particularly a gasoline engine.

We claim:

1. An apparatus for learning control of the air-fuel ratio of an air-fuel mixture in an electronically controlled fuel injection type internal combustion engine, wherein comprises engine-driving state detecting means including at least first detecting means 21 for detecting a flow quantity Q of intake air in the engine, second detecting means 31 for detecting a rotation speed N of the engine and third detecting means 26 for detecting an actual air-fuel ratio λ of the air-fuel mixture sucked in the engine by detecting a concentration of an exhaust component, fuel injection means 25 for injecting and supplying a fuel to the engine in an on-off manner in response to a driving pulse signal, basic fuel injection quantity operating means 201 for operating a basic injection quantity Tp of the fuel to be supplied to the engine based on the flow quantity Q of intake air in the engine, which is put out by said first detecting means 21, and the engine rotation speed N put out by said second detecting means 31, reloadable memory means 205 in which a learning correction coefficient αo for correcting said basic fuel injection quantity Tp is stored in advance for each of engine-driving state areas of a predetermined range, learning correction coefficient retrieval means 206 for retrieving the learning correction coefficient αo from said memory means 205 according to the actually detected driving state of the engine, feedback correction coefficient setting means 202 for increasing, for decreasing, and for setting a feedback correction coefficient α for correcting said basis fuel injection quantity Tp so that the actual air-fuel ratio λ put out by said third detecting means 26 is brought close to a preset aimed air-fuel ratio λt, learning correction coefficient renewal means 207 for setting a new learning correction coefficient αo(new), which is operated based on the feedback correction coefficient α set by said feedback correction coefficient setting means 202 and the learning correction coefficient αo retrieved by said learning correction coefficient retrieval means 206 according to the detected driving state of the engine, as the learning correction coefficient αo of the corresponding engine-driving state area of said memory means, learning advance degree judging means 209 for judging a degree of the advance of learning in each engine-driving state area by a frequency C of renewal of the learning correction by said correction renewal means 210 for estimating and operating the learning correction coefficient αo of the engine-driving state area, in which the degree of the advance of learning is judged as being small by said learning advance degree judging means 209, with a certain relation to the learning correction coefficient αo of the engine-driving state area in which the learning advance degree is judged as being large and setting said estimated learning correction coefficient αs as the learning correction coefficient αo of the corresponding engine-driving state area of said memory means 205, fuel injection quantity operating means 203 for correcting the basic fuel injection quantity Tp based on retrieval and on renewed learning correction coefficients αo and further correcting the basic fuel injection quantity Tp based on the feedback correction coefficient α set by said feedback correction coefficient setting means 202, and operating a fuel injection quantity Ti based on said corrected value, and driving pulse signal output means 204 for putting out the driving pulse signal corresponding to the fuel injection quantity Ti to said fuel injection means 25.

2. An apparatus for learning control of the air-fuel ratio of an air-fuel mixture in an electronically controlled fuel injection type internal combustion engine according to claim 1, wherein said third detecting means 26 comprises an $O_2$ sensor for detecting $O_2$ concentration in the engine exhaust gas and comparing means for comparing an output voltage of said $O_2$ sensor with a predetermined slice level voltage SL.

3. An apparatus for learning control of the air-fuel ratio of an air-fuel mixture in an electronically controlled fuel injection type internal combustion engine according to claim 1, wherein the feedback correction coefficient setting means 202 comprises means for setting the feedback correction coefficient α by increasing and by decreasing the coefficient at least by an integration component.

4. An apparatus for learning control of the air-fuel ratio of an air-fuel mixture in an electronically controlled fuel injection type internal combustion engine according to claim 1, wherein the learning correction coefficient renewal means 207 is means for effecting renewal to a new learning correction efficient according to the following equation:

$$\alpha o(new) \leftarrow \alpha o + \Delta\alpha / N$$

wherein Δα stands for the quantity of the deviation between the feedback correction coefficient α and the standard value α1 and M is a constant.

5. An apparatus for learning control of the air-fuel ratio of an air-fuel mixture in an electronically controlled fuel injection type internal combustion engine according to claim 1, wherein the basic fuel injection quantity operating means 201 is means for operating the basic fuel injection quantity Tp according to the equation of $Tp = K \cdot Q/N$ in which K is a constant.

6. An apparatus for learning control of the air-fuel ratio of an air-fuel mixture in an electronically controlled fuel injection type internal combustion engine according to claim 5, wherein the fuel injection quantity operating means 203 is means for operating the fuel injection quantity Ti according to the following equation:

$$Ti = Tp \times COEF \times \alpha o \times \alpha + Ts$$

wherein COEF stands for a function of various correction coefficients for increasing the quantity of the fuel according to the driving state of the engine and Ts is a correction value based on the variation of the power source voltage.

7. An apparatus for learning control of the air-fuel ratio of an air-fuel mixture in an electronically controlled fuel injection type internal combustion engine according to claim 1, wherein the engine-driving state detecting means further comprises fourth detecting means for detecting the stationary state of the engine and the learning correction coefficient renewal means 207 is actuated when the engine is in the stationary state.

8. An apparatus for learning control of the air-fuel ratio of an air-fuel mixture in an electronically controlled ratio injection type internal combustion engine according to claim 7, wherein said fourth detecting means comprises car speed detecting means 35, means 33 for detecting a neutral position of a transmission and means 24 for detecting an opening degree of a throttle valve disposed in the intake passage of the engine, and when the state of the constant car speed, a gear position different from the neutral position and the constant opening degree of the throttle valve is continued for a predetermined time, it is judged that the engine is in the stationary state.

9. An apparatus for learning control of the air-fuel ratio of an air-fuel mixture in an electronically controlled fuel injection type internal combustion engine according to claim 7, wherein said fourth detecting means is means for detecting that the engine rotation speed N put out from the second detecting means 31 and the basic fuel injection quantity Tp put out from the basic fuel injection quantity operating means 21 are present for a predetermined time in a specific engine-driving state area of said memory means 205.

10. An apparatus for learning control of the air-fuel ratio of an air-fuel mixture in an electronically controlled fuel injection type internal combustion engine according to claim 7, wherein the third detecting means 26 comprises an $O_2$ sensor for detecting $O_2$ concentration of the engine exhaust and comparing means for comparing an output voltage of said $O_2$ sensor with a predetermined slice level voltage SL, the fourth detecting is means for detecting that the engine rotation speed N put out from the second detecting means 21 and the basic fuel injection quantity Tp put out from the basic fuel injection quantity operating means 201 are present for a predetermined time in a specific engine-driving state area, and said predetermined time is counted by a frequency of reversion of increase and decrease in the output voltage of said $O_2$ sensor.

11. An apparatus for learning control of the air-fuel ratio of an air-fuel mixture in an electronically controlled fuel injection type internal combustion engine according to claim 1, wherein the estimated learning correction coefficient renewal means 210 is means for interpolating the learning correction coefficient $\alpha o$ of the driving state area of a small degree of advance of learning from the learning correction coefficients $\alpha o$ of a plurality of driving state areas of a large degree of the advance of learning present in the vicinity of said driving state area of a small degree of the advance of learning based on the results of the judgment made by the learning advance degree judging means 209.

12. An apparatus for learning control of the air-fuel ratio of an air-fuel mixture in an electronically controlled fuel injection type internal combustion engine according to claim 1, wherein said memory means 205 is means for storing the learning correction coefficient $\alpha o$ determined for each determined area by the basic fuel injection quantity Tp and engine rotation speed N.

13. An apparatus for learning control of the air-fuel ratio in an air-fuel mixture in an electronically controlled air fuel injection type internal combustion engine according to claim 12, wherein the estimated learning correction coefficient renewal means 210 comprises area retrieving means **210*a* for retrieving other driving state areas having the same basic injection quantity Tp as the basic injection quantity Tp of the driving state area in which the learning correction coefficient $\alpha o$ is corrected by the learning correction coefficient renewal means 207 and estimation renewal means 210*b* for setting the learning correction coefficient $\alpha o$ of the renewed driving state area as the learning correction coefficient of the driving state area which is judged to have a small degree of the advance of learning by said learning advance degree judging means 209** among the retrieved driving state areas.

14. An apparatus for learning control of the air-fuel ratio in an air-fuel mixture in an electronically controlled air fuel injection type internal combustion engine according to claim 12, wherein the estimated learning correction coefficient renewal means 21 comprises area retrieving means **210*a* for retrieving other driving state areas having the same intake air flow amount Q as the intake air flow quantity Q detected by the first detecting means 21 in the driving state area in which the learning correction coefficient $\alpha o$ is corrected by the learning correction coefficient renewal means 207 and estimation renewal means 210*b* for setting the learning correction coefficient $\alpha o$ of the renewed driving state area as the learning correction coefficient of the driving state area which is judged to have a small degree of the advance of learning by said learning advance degree judging means 209** among the retrieved driving state areas.

15. An apparatus for learning control of the air-fuel ratio of an air-fuel mixture in an electronically controlled fuel injection type internal combustion engine according to any one of claims 11, 13 or 14, wherein the learning advance degree judging means 209 comprises comparing means **209*a* for comparing the degree of the advance of learning in the driving state area renewed by the learning correction coefficient renewal means 207** with the degree of the advance of learning in said other driving state areas.

16. An apparatus for learning control of the air-fuel ratio in an air-fuel mixture in an electronically controlled air fuel injection type internal combustion engine according to any one of claims 11, 13 or 14, wherein the learning advance degree judging means 209 is means for judging the degree of the advance of learning by comparing the learning correction coefficient renewal frequency C with a predetermined value C1.

17. An apparatus for learning control of the air-fuel ratio of an air-fuel mixture in an electronically controlled fuel injection type internal combustion engine according to claim 16, wherein the predetermined value C1 of the learning correction coefficient renewal frequency is arithmetically operated based on the mean value of learning correction coefficient renewal frequencies C of all the driving state areas.

* * * * *